US007909072B2

(12) United States Patent
Lei et al.

(10) Patent No.: US 7,909,072 B2
(45) Date of Patent: Mar. 22, 2011

(54) MICRO-ADJUSTMENT DEVICE FOR THE ANGLE STOP PLANK OF A PLANAR

(75) Inventors: Xun Lei, Federal Way, WA (US); Bor Yann Chuang, Taiping (TW)

(73) Assignee: Walter Meier (Manufacturing) Inc., La Vergne, TN (US)

( * ) Notice: Subject to any disclaimer, the term of this patent is extended or adjusted under 35 U.S.C. 154(b) by 0 days.

(21) Appl. No.: 12/165,253

(22) Filed: Jun. 30, 2008

(65) Prior Publication Data

US 2008/0257453 A1 Oct. 23, 2008

Related U.S. Application Data

(63) Continuation of application No. 10/656,324, filed on Sep. 8, 2003, now Pat. No. 7,392,830.

(51) Int. Cl.
*B27C 1/12* (2006.01)

(52) U.S. Cl. ..... 144/253.8; 144/253.5; 269/303

(58) Field of Classification Search ..... 144/114.1, 144/253.1, 253.5, 253.6, 253, 7, 253.8; 269/303, 269/315, 318
See application file for complete search history.

(56) References Cited

U.S. PATENT DOCUMENTS

| | | | | |
|---|---|---|---|---|
| 381,752 | A * | 4/1888 | Beach | 83/438 |
| 2,758,617 | A * | 8/1956 | Taylor | 144/253.8 |
| 2,872,957 | A * | 2/1959 | Eschenburg | 144/253.8 |
| 4,971,123 | A * | 11/1990 | Braunbach | 144/253.8 |
| 5,022,447 | A | 6/1991 | Monobe | |
| 5,533,557 | A * | 7/1996 | Jedlicka et al. | 144/253.8 |
| 6,026,870 | A * | 2/2000 | Liu | 144/253.8 |
| 6,467,516 | B1 * | 10/2002 | Liao | 144/253.8 |
| 6,478,060 | B1 * | 11/2002 | Liao | 144/253.8 |
| 6,494,239 | B1 * | 12/2002 | Liao | 144/129 |
| 7,093,627 | B2 | 8/2006 | Chuang | |
| 7,198,082 | B2 | 4/2007 | Chuang | |
| 7,328,732 | B2 | 2/2008 | Chuang | |
| 7,392,830 | B2 * | 7/2008 | Lei et al. | 144/253.8 |
| 2005/0051238 | A1 | 3/2005 | Chuang | |
| 2006/0107813 | A1 | 5/2006 | Chuang | |
| 2006/0124201 | A1 | 6/2006 | Chuang | |

FOREIGN PATENT DOCUMENTS

DE 3841480 A1 11/1989

OTHER PUBLICATIONS

WMH Tool Group, Inc., Powermatic 6' Jointer Model 54A, Instruction Manual & Parts List, published prior to Sep. 2, 2002, 32 pp.

* cited by examiner

*Primary Examiner* — Shelley Self
(74) *Attorney, Agent, or Firm* — Schiff Hardin LLP

(57) ABSTRACT

An adjustable stop plank for a power tool includes a drive mechanism connected to the stop plank for continuous adjustment of the angle of the stop plank with respect to the work surface and has a display for indicating the current angle of the stop plank. In one form, the micro-adjusting device for the stop plank of a power tool includes a hand wheel unit provided on the holding frame operable to continuously adjust the angle of the stop plank. The power tool may include indicia to indicate a plurality of angles for the stop plank and an index for indicating on the indicia the current angle of the stop plank.

16 Claims, 8 Drawing Sheets

MICRO-ADJUSTMENT DEVICE FOR THE ANGLE STOP PLANK OF A PLANAR

CROSS REFERENCE

This application is a continuation of U.S. Ser. No. 10/656,324 filed Sep. 8, 2003 now U.S. Pat. No. 7,392,830

BACKGROUND OF THE INVENTION

1. Field of the Invention

This invention relates to a micro-adjustment device for the angle stop plank of a planer, particularly to one able to micro-adjust the slanting angles of the angle stop plank of a planer accurately and quickly.

2. Description of the Prior Art

A conventional planer has a stop plank positioned stationary on its wood conveying table, always maintaining a single angle between the stop plank and the wood conveying table; therefore after a wood material is positioned to lean on the stop plank for planing, it can be planed only at a single angle, making it impossible to be planed at a specific angle. To carry out planing at a specific angle, it is necessary to draw a line on the wood material in advance and then perform planing with the help of certain auxiliary tools, and is impossible to plane the wood material with great accuracy, making it inconvenient in performing planing work.

In view of the above-mentioned drawback, another conventional planer is provided with an adjustable stop plank which can be adjusted and positioned at frequently employed angles, such as an interior angle of 45 degrees, a right angle or an exterior angle of 45 degrees, which is able to carry out planing at a specific angle safely and conveniently. However, although the stop plank of the conventional planer can be adjusted and positioned at certain specific angles, yet such a design cannot fully meet the needs in planing work because many wood materials may be required to be planed at other different angles rather than at the aforesaid specific angles.

SUMMARY OF THE INVENTION

A main objective of the invention is to offer a micro-adjustment device for the angle stop plank of a planer, able to accurately micro-adjust the stop plank of a planer at any angle from an interior angle of 45 degrees to an exterior angle of 45 degrees by turning around a hand wheel.

Another objective of the invention is to offer a micro-adjustment device for the angle stop plank of a planer, able to have the angle stop plank accurately and quickly adjusted at one of frequently employed specific angles, such as an interior angle of 45 degrees, a right angle and an exterior angle of 45 degrees without help of a graduation ruler.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
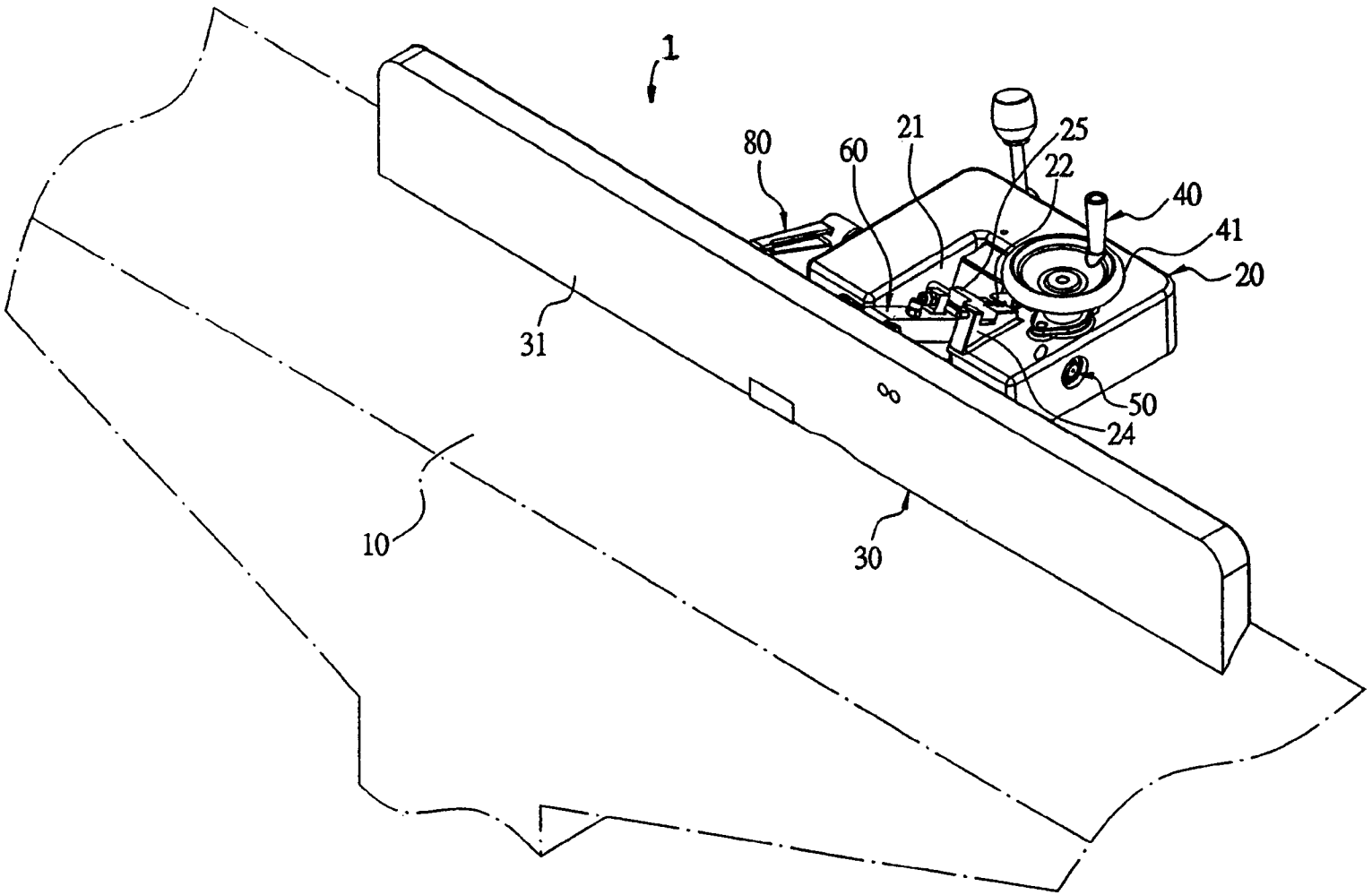
FIG. 1 is a partial perspective view of a micro-adjustment device for the angle stop plank of a planer in the present invention.
Figure 2:
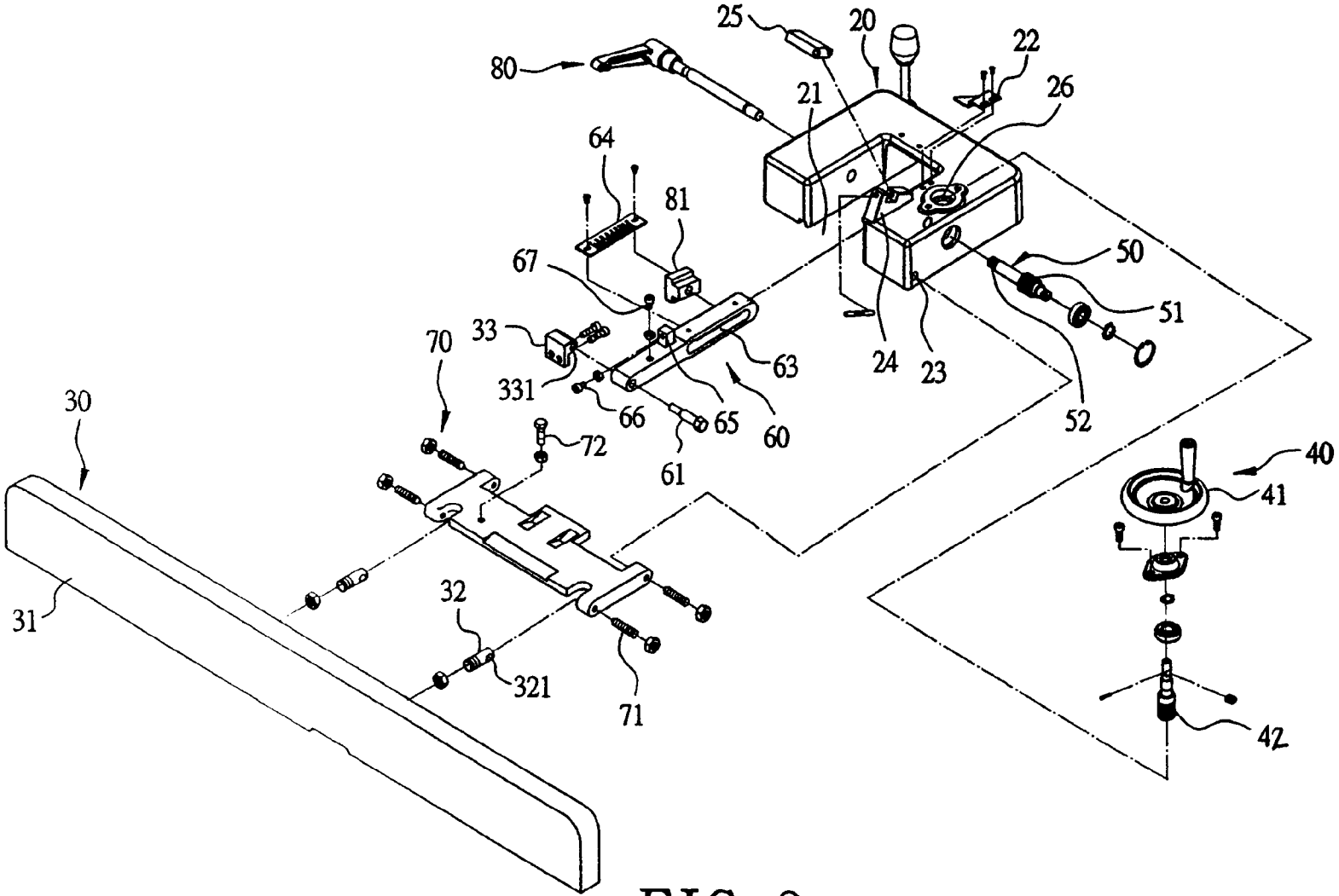
FIG. 2 is an exploded perspective view of the micro-adjustment device for the angle stop plank of a planer in the present invention.

A preferred embodiment of a micro-adjustment device for the angle stop plank of a planer in the present invention, as shown in FIGS. 1 to 4, includes a wood-conveying table 10, a holding frame 20, a stop plank 30, a hand wheel unit 40, a transmission rod 50, an upper connecting rod 60, a lower connecting rod 70 and a locking handle 80 combined together.

The wood-conveying table 10 has one side combined with the upper holding frame 20 connected with the stop plank 30, which is located at one side on the top side of the wood-conveying table 10 for a wood material to be leaned thereon during planing.

The holding frame 20 has an inverted U-shaped body, having an accommodating space 21 formed in the center, and an index hand 22 provided at a preset location of the top side and pointing to one side of the accommodating space 21.

The stop plank 30 has its front side formed with a leaning surface 31 for a wood material to lean thereon and its rear lower side locked with two connecting bolts 32 separately positioned at preset locations and respectively having a lateral insert hole 321. The stop plank 30 further has a rod-connecting base 33 with a lateral shaft hole 331 secured near the upper edge of its rear central wall.

The hand wheel unit 40 consists of a hand wheel 41 and a worm 42 actuated to rotate by the hand wheel 41. The worm 42 is vertically inserted in a through hole 26 in the top side of the holding frame 20.

The transmission rod 50 to be transversely inserted in the holding frame 20 and positioned at the lower end of the worm 42 of the hand wheel unit 40. The transmission rod 50 has one end provided with a worm wheel 51 to be meshed with the worm 42 and the other end formed with a transmission gear 52.

Figure 5:
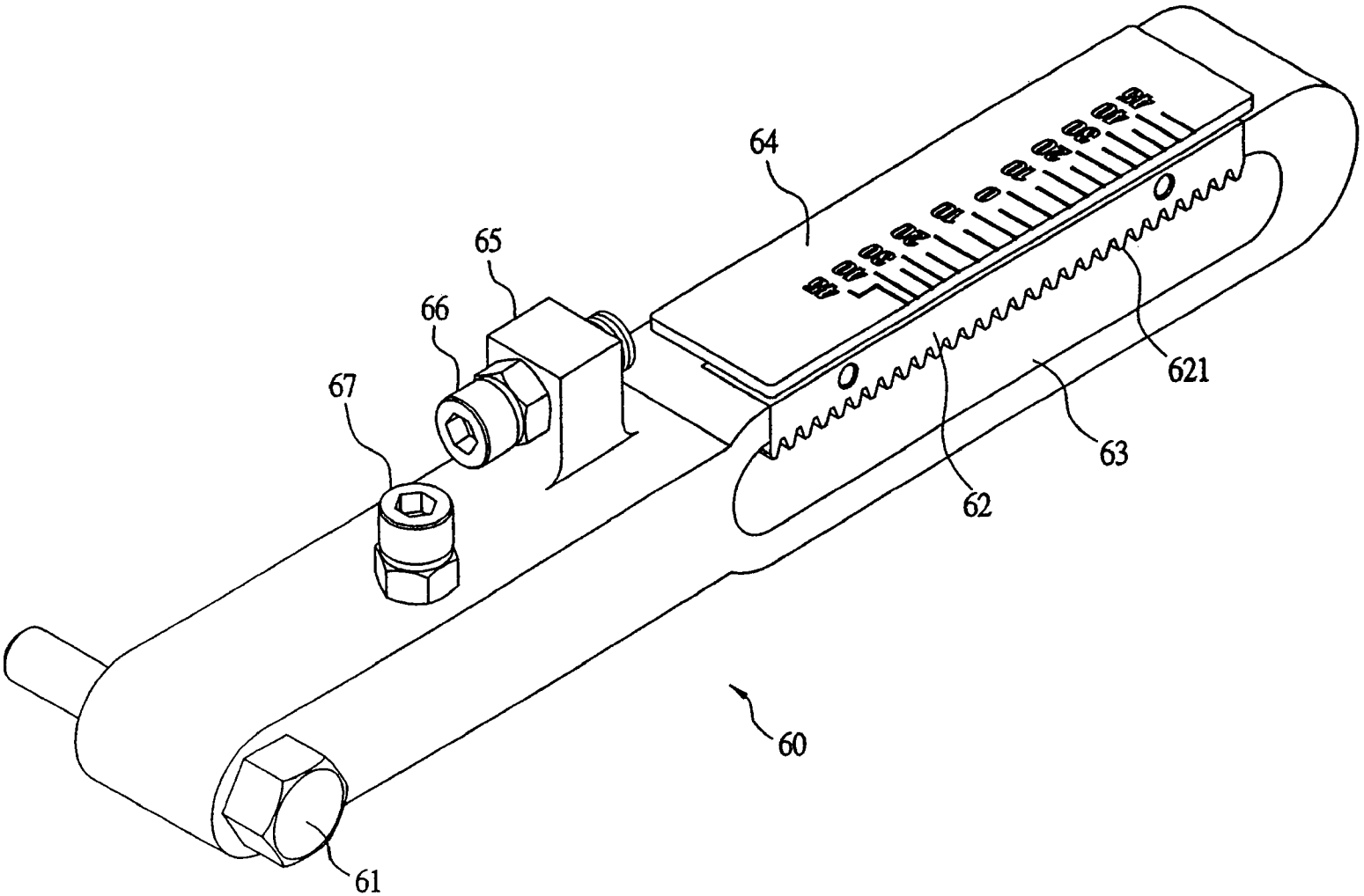
FIG. 5 is a perspective view of the upper connecting rod of the micro-adjustment device for the angle stop plank of a planer in the present invention.

The upper connecting rod 60, as shown in FIG. 5, to be positioned in the accommodating space 21 of the holding frame 20, is provided with a bolt 61 at the front end to be inserted in the shaft hole 331 of rod-connecting base 33 fixed at the rear wall of the stop plank 30, and a rack 62 at the rear upper side, with a guiding groove 63 formed beneath the rack 62, which is formed with multiple row teeth 621 to be meshed with the transmission gear 52 of the transmission rod 50. Further, the upper connecting rod 60 has the top side above the guiding groove 63 provided with a graduated ruler 64 having angle graduations marked thereon. Thus, the graduated ruler 64 on the upper connecting rod 60 in cooperation with the index hand 22 on the holding frame 20 can indicate the positioning angle of the stop plank 30 after it is adjusted.

The lower connecting rod 70 is shaped like a plate and has two bolts 71 respectively provided at the opposite ends of its rear side to be respectively and pivotally inserted in two insert holes 23 at the opposite lower front sides of the holding frame 20, and another two bolts 71 respectively provided at the opposite ends of its front side to be respectively and pivotally inserted in the two insert holes 321 of the two connecting bolts 32 of the stop plank 30. Thus, the pivotal joints of the lower connecting rod 70 with the holding frame 20 and the stop plank 30 respectively make up a turning fulcrum.

The locking handle 80 is transversely and pivotally inserted in the left side of the holding frame 20 and positioned opposite to the worm 42. The locking handle 80 has its end screwed with a locking block 81 to be fitted in the opposite side of the guiding groove 63 of the upper connecting rod 60 and limited to rotate therein. Thus, when the locking handle 80 is turned and locked tightly, its locking block 81 will be actuated to push tightly against or release the upper connecting rod 60.

Figure 6:
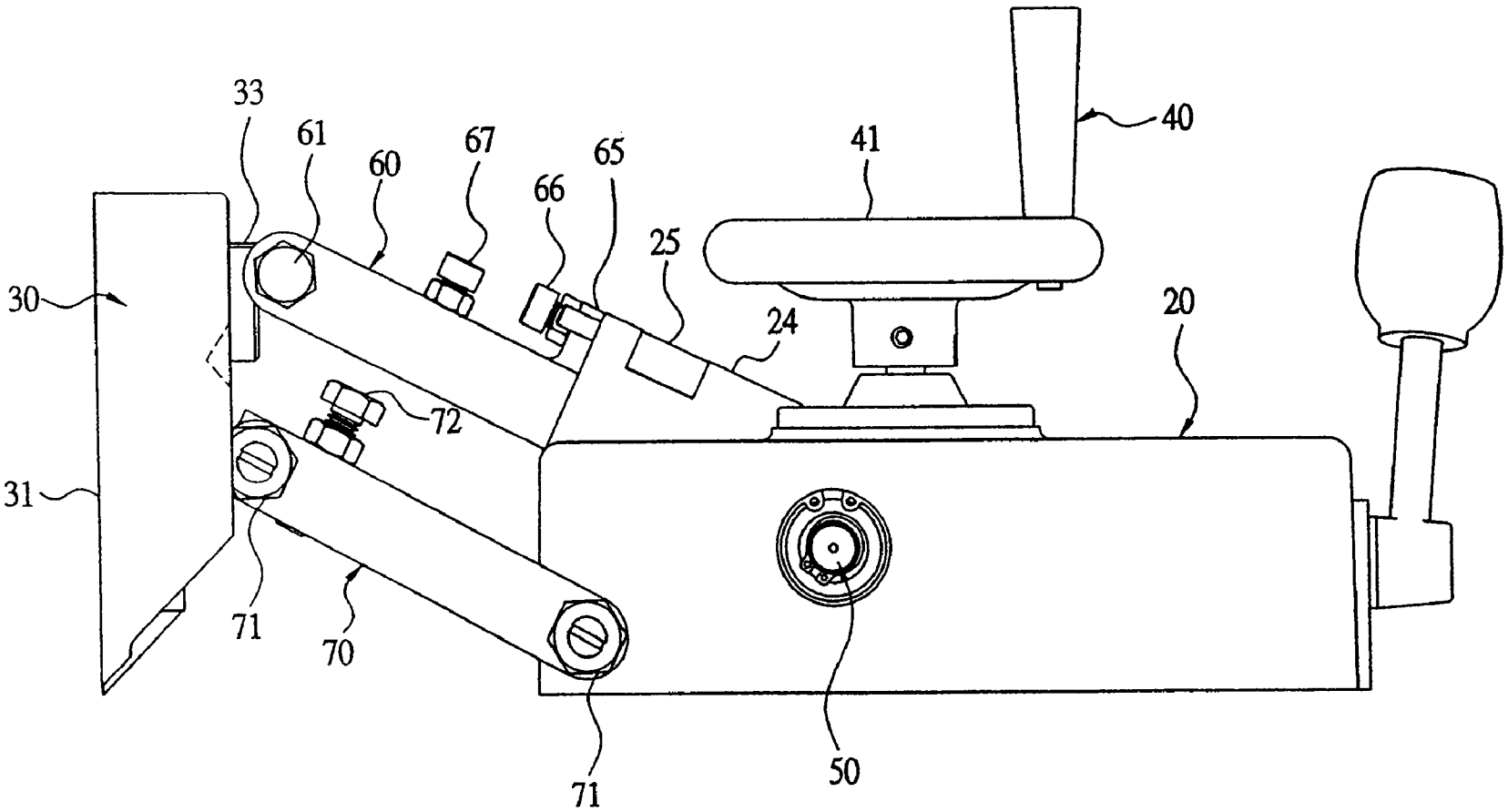
FIG. 6 is a cross-sectional view of the micro-adjustment device for the angle stop plank of a planer in the present invention, showing the angle stop plank adjusted and positioned at a right angle.

In addition, the micro-adjustment device of this invention is also provided with three positioning methods able to quickly position the stop plank at three specific angles:

1. A positioning method of a right angle: Referring to FIG. 6, the holding frame 20 is formed integral with a stop base 24 protruding upward on one side abutting the upper connecting rod 60. The stop base 24 has a pivotal stop block 25 able to be rotated and positioned on the top side of the upper connecting rod 60 at times. The upper connecting rod 60 is provided with a bolt base 65 protruding upward at a preset location on the top side thereof and having a stop bolt 66 screwed therein. Thus, when the stop plank 30 is turned and adjusted, the stop bolt 66 of the upper connecting rod 60 and the stop block 25 of the holding frame 20 will push against each other and quickly position the stop plank 30 at the angle of 90 degrees.

Figure 7:
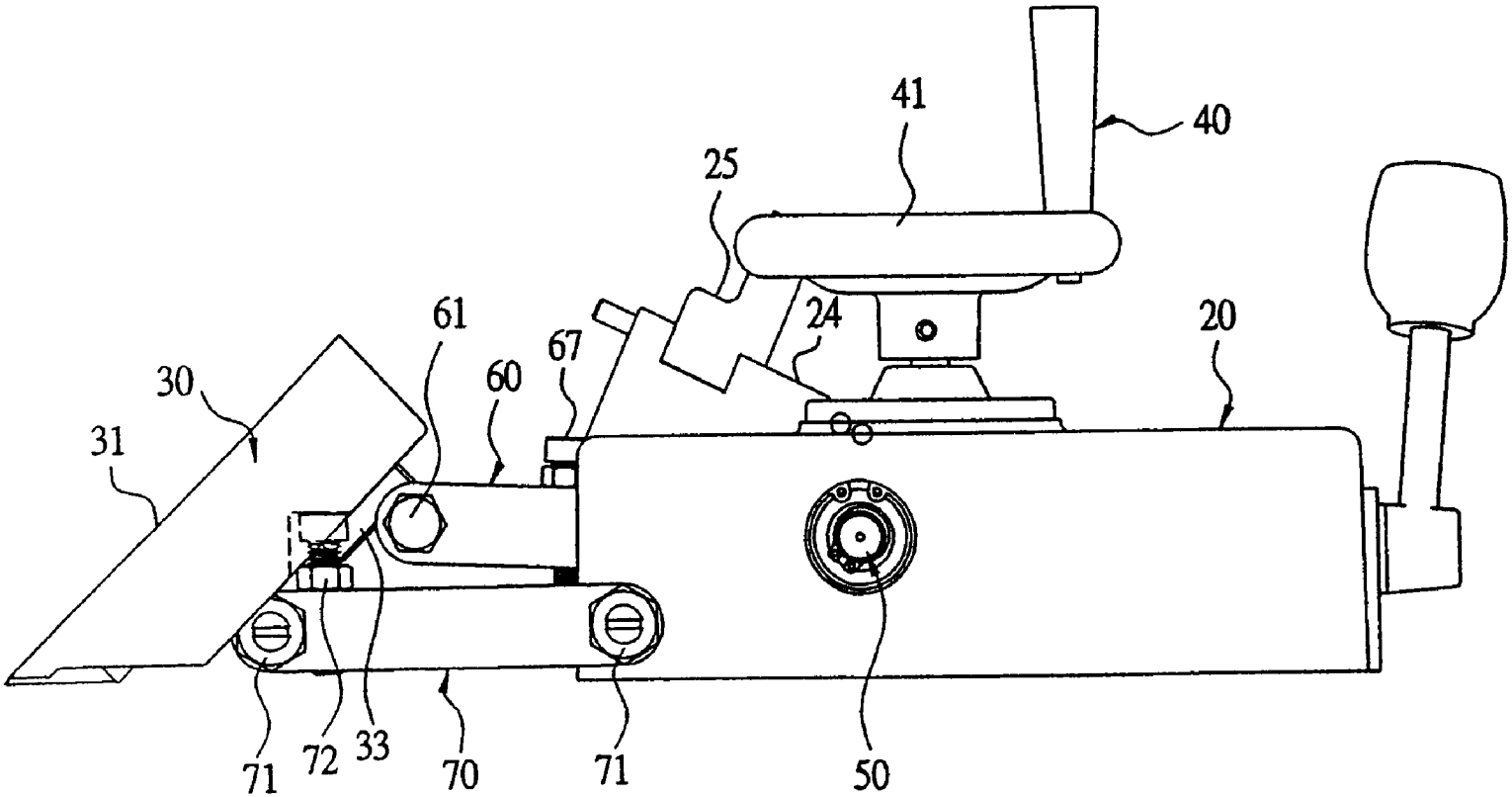
FIG. 7 is a cross-sectional view of the micro-adjustment device for the angle stop plank of a planer in the present invention, showing the angle stop plank adjusted and positioned at an exterior angle of 45-degrees.

2. A positioning method of an exterior angle of 45 degrees: Referring to FIG. 7, the lower connecting rod 70 is provided with a stop bolt 72 at a preset location on the top side thereof. Thus, when the stop plank 30 is turned and adjusted, the stop bolt 72 of the lower connecting rod 70 will push against a preset part on the rear wall of the stop plank 30 and quickly position the stop plank 30 at the exterior angle of 45 degrees.

Figure 8:
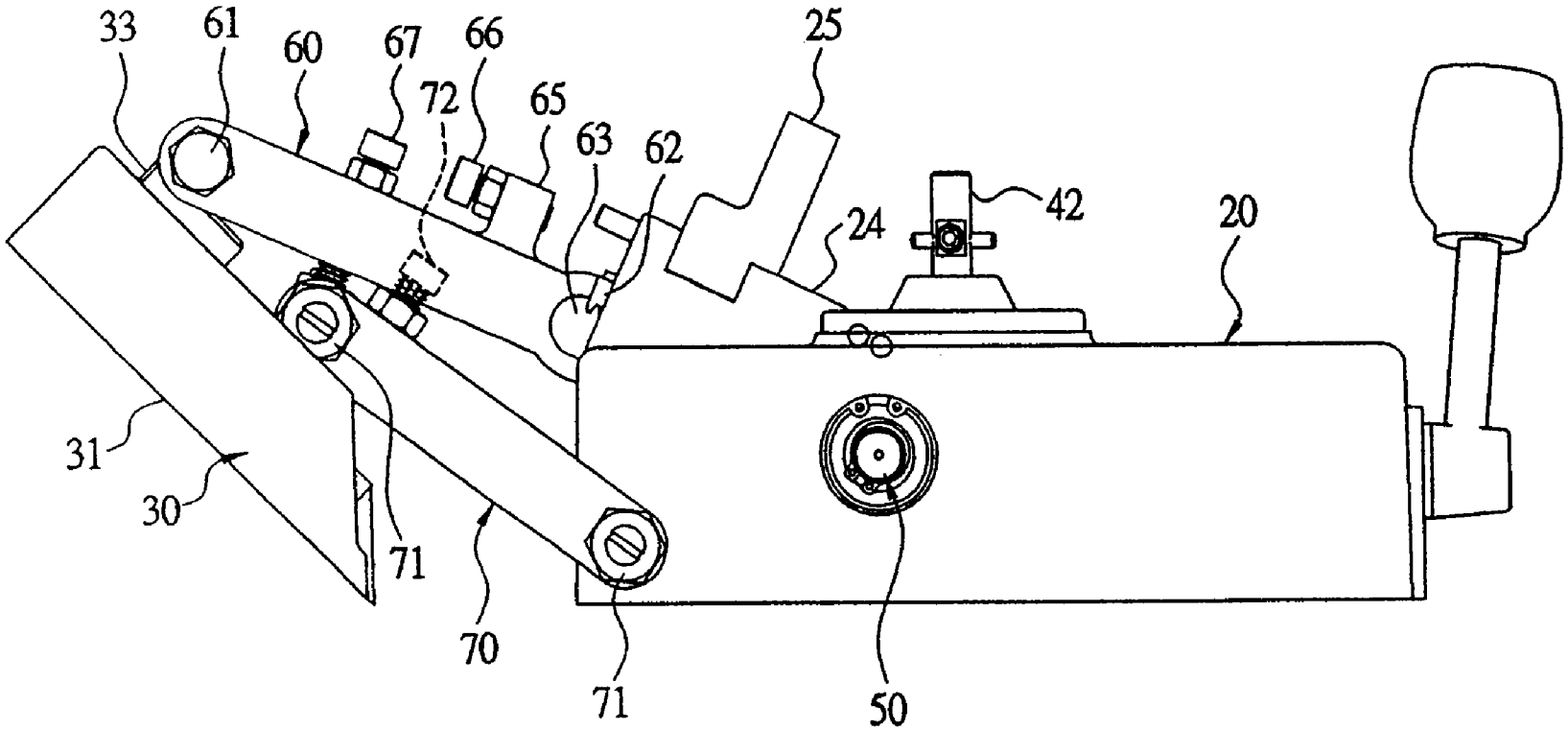
FIG. 8 is a cross-sectional view of the micro-adjustment device for the angle stop plank of a planer in the present invention, showing the angle stop plank adjusted and positioned at an interior angle of 45-degrees.

3. A positioning method of an interior angle of 45 degrees: Referring to FIG. 8, the upper connecting rod 60 is provided with a stop bolt 67, in front of the bolt base 65, on the top side thereof. Thus, when the stop plank 30 is turned and adjusted, the stop bolt 67 will push against a preset part on the top side of the lower connecting rod 70 and quickly position the stop plank 30 at the interior angle of 45 degrees.

In operating and using the micro-adjustment device, as shown in FIGS. 6, 7 and 8, before the stop plank 30 is adjusted, the stop bolt 66 on the upper connecting rod 60 for positioning an angle of 90 degrees and the stop bolt 67 for positioning an exterior angle of 45 degrees and the stop bolt 72 on the lower connecting rod 70 for positioning an interior angle of 45 degrees are respectively screwed and adjusted to an accurate position. Thus, when the hand wheel 41 is turned around, the upper connecting rod 60 will be actuated by the worm 42 and the transmission rod 50 to pull or push the stop plank 30, and simultaneously the stop plank 30 will be turned in a specific direction by means of the turning fulcrums respectively formed at the pivotal joints at the front and the rear end of the lower connecting rod 70.

Specifically, to position the stop plank 30 at the interior angle of 45 degrees, the hand wheel 41 is turned in a proper direction to let its worm 42 actuate the worm wheel 51 of the transmission rod 50 to rotate. In the meantime, the transmission rod 50 rotates, having its transmission gear 52 actuate the row of teeth 621 together with the upper connecting rod 60 to move forward and push the stop plank 30 to force the upper portion of the stop plank 30 to slant outward until the stop bolt 67 adjusted in advance on the upper connecting rod 60 exactly pushes against the top side of the lower connecting rod 70, thus able to position the stop plank 30 at the interior angle of 45 degrees.

To position the stop plank 30 at the right angle, the stop block 25 on the holding frame 20 is pulled toward the upper connecting rod 60 and lies on the top side of the upper connecting rod 60. Then, the hand wheel 41 is turned counterclockwise to let the row of teeth 621 of the upper connecting rod 60 actuated by the transmission gear 52 of the transmission rod 50 to move backward and pull the stop plank 30 until the stop bolt 66 adjusted in advance on the upper connecting rod 60 exactly pushes against the stop block 25, thus able to position the stop plank 30 at the right angle.

To position the stop plank 30 at the exterior angle of 45 degrees, the stop block 25 of the holding frame 20 is pulled outward to enable the upper connecting rod 60 to move backward smoothly. Then, the hand wheel 41 is turned around to let the row of teeth 621 together with the upper connecting rod 60 actuated by the transmission gear 52 of the transmission rod 50 to move backward and pull the stop plank 30 until a preset part on the rear wall of the stop plank 30 exactly pushes against the stop bolt 72 on the top side of the lower connecting rod 70, thus able to position the stop plank 30 at an exterior angle of 45 degrees. The scope of the adjustable angle of the stop plank 30 is 90 degrees from the interior 45 degrees to the exterior 45 degrees.

Figure 3:
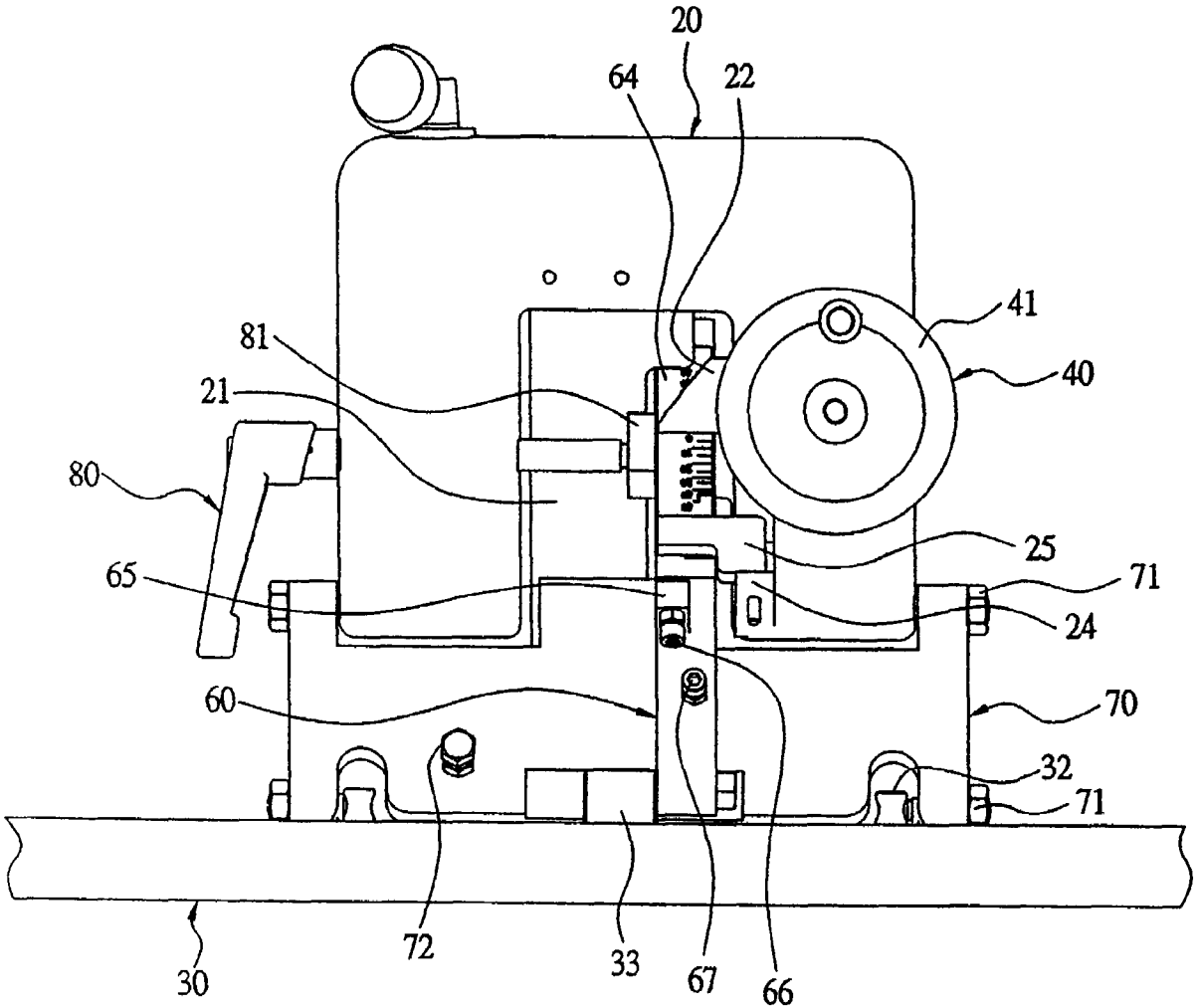
FIG. 3 is a top view of the micro-adjustment device for the angle stop plank of a planer in the present invention.
Figure 4:
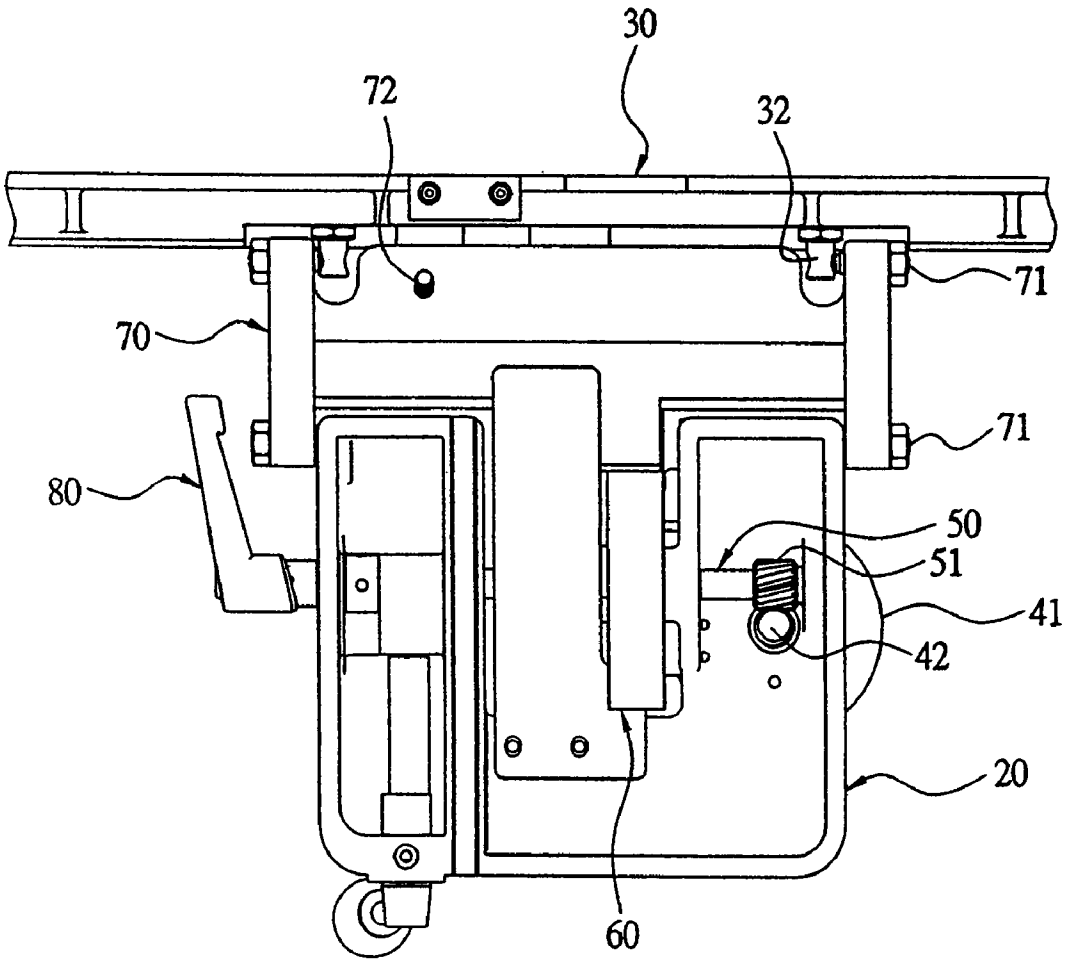
FIG. 4 is a bottom view of the micro-adjustment device for the angle stop plank of a planer in the present invention.

Apart from being quickly positioned at the above-mentioned specific angles, the stop plank 30 can also be precisely micro-adjusted at any angle, as shown in FIG. 3. To micro-adjust the stop plank 30, the hand wheel 41 is turned around to actuate the upper connecting rod 60 to move back or forth and push or pull the stop plank 30 to control its slanting angle. As mentioned above, the holding frame 20 is provided thereon with the index hand 22 pointing to the graduated ruler 64 on the upper connecting rod 60; therefore when the hand wheel 41 is turned to micro-adjust the stop plank, the upper connecting rod 60 is moved back or forth according to the angle graduations indicated on the angle graduation ruler 64 by the index hand 22 so as to micro-adjust and position the stop plank 30 at an expected angle precisely and quickly.

While the preferred embodiment of the invention has been described above, it will be recognized and understood that various modifications may be made therein and the appended claims are intended to cover all such modifications that may fall within the spirit and scope of the invention.

We claim:

1. An adjustable stop plank assembly for a power tool having a work surface, the adjustable stop plank assembly comprising:

a stop plank mounted adjacent or proximate to the work surface;

a drive mechanism connected to the stop plank for continuous adjustment of an angle of the stop plank with respect to the work surface within a predetermined range of angles;

an actuator operably connected to the drive mechanism for operation thereof to adjust the angle of the stop plank such that rotational displacement of the actuator in a first direction causes angular displacement of the stop plank relative to the work surface in a first corresponding direction and rotational displacement of the actuator in a second direction causes angular displacement of the stop mounted on or to abut against said drive mechanism plank relative to the work surface in a second corresponding direction different from the first corresponding direction; and at least one stop to obstruct movement of the stop plank beyond at least one predetermined angle.

2. An apparatus according to claim 1, wherein the drive mechanism has an interface with at least one tooth that allows the stop plank to be moved to different angles with respect to the work surface.

3. An apparatus according to claim 1, wherein the drive mechanism includes components having a meshed interface which cooperate to adjust the angle of the stop plank.

4. An apparatus according to claim 1, wherein the drive mechanism has a threaded interface that allows the stop plank to be moved to different angles with respect to the work surface.

5. An apparatus according to claim 1, wherein the actuator is hand operated to adjust the angle of the stop plank.

6. An apparatus according to claim 4, wherein the actuator is a hand operated actuator including a spindle movable in a clockwise direction to adjust the angle of the stop plank in a first direction and movable in a counterclockwise direction to adjust the angle of the stop plank in a second direction.

7. An apparatus according to claim 1, wherein the at least one stop comprises an adjustable hinderer which may be adjusted to obstruct movement of the stop plank beyond the at least one predetermined angle.

8. An apparatus according to claim 1, wherein the at least one stop comprises an adjustable bolt that obstructs movement of the stop plank beyond a predetermined angle.

9. An apparatus according to claim 1, wherein the actuator may be rotated in a clockwise or counterclockwise direction to make micro-adjustments to the angle of the stop plank.

10. An apparatus according to claim 1, further comprising a display for indicating the current angle of the stop plank.

11. An apparatus according to claim 10, wherein the display comprises:

indicia to indicate a plurality of angles for the stop plank; and an index for indicating on the indicia the current angle of the stop plank.

12. An apparatus comprising:

a workpiece support table having an adjustable stop plank for positioning a workpiece and a drive mechanism for adjusting an angle of the stop plank with respect to the workpiece support table;

an actuator operably connected to the drive mechanism for operation thereof to adjust the angle of the stop plank such that rotational displacement of the actuator in a first direction causes angular displacement of the stop plank in a first corresponding direction and rotational displacement of the actuator in a second direction causes angular displacement of the stop plank in a second corresponding direction different from the first corresponding direction;

a display for indicating a current angle of the stop plank with respect to the workpiece support table; and first and second adjustable stops on said drive mechanism for limiting angular displacement of the stop plank by said actuator beyond respective first and second limits, said adjustable stops being user adjustable to vary the respective first and second limits of the stop plank angular displacement.

13. An apparatus according to claim 12 wherein the display further comprises:

indicia to indicate a plurality of angles for the stop plank; and an index for indicating on the indicia the current angle of the stop plank.

14. An apparatus having a work surface, comprising:

a stop plank mounted adjacent to the work surface;

a drive mechanism operably connected to the stop plank for adjustment of an angle of the stop plank relative to the work surface;

an actuator operably connected to the drive mechanism for operating the drive mechanism to adjust the angle of the stop plank such that rotational displacement of the actuator in a first direction causes angular displacement of the stop plank in a first corresponding direction and rotational displacement of the actuator in a second direction causes angular displacement of the stop plank in a second corresponding direction different from the first corresponding direction; and at least one adjustable stop mounted on or to abut against said drive mechanism to limit angular displacement of the stop plank by said drive mechanism beyond a stop angle, said at least one adjustable stop being user adjustable to vary the stop angle.

15. An apparatus according to claim 14 wherein the drive mechanism includes at least one gear operably connected to the stop plank for adjusting the angle of the stop plank relative to the work surface.

16. An apparatus according to claim 15, wherein the drive mechanism includes a rack and pinion gear set.

* * * * *